US006529094B1

(12) United States Patent
Kubo et al.

(10) Patent No.: US 6,529,094 B1
(45) Date of Patent: Mar. 4, 2003

(54) DIELECTRIC RESONANCE DEVICE, DIELECTRIC FILTER, COMPOSITE DIELECTRIC FILTER DEVICE, DIELECTRIC DUPLEXER, AND COMMUNICATION APPARATUS

(75) Inventors: Hiroyuki Kubo, Kusatsu (JP); Yukihiro Nakatani, Kyoto (JP)

(73) Assignee: Murata Manufacturing Co. Ltd. (JP)

( * ) Notice: Subject to any disclaimer, the term of this patent is extended or adjusted under 35 U.S.C. 154(b) by 27 days.

(21) Appl. No.: 09/645,848

(22) Filed: Aug. 24, 2000

(30) Foreign Application Priority Data

Aug. 24, 1999 (JP) ..... 11-236677

(51) Int. Cl.[7] ..... H01P 7/10; H01P 1/20
(52) U.S. Cl. ..... 333/134; 333/219.1; 333/234
(58) Field of Search ..... 333/219.1, 234, 333/134, 202

(56) References Cited

U.S. PATENT DOCUMENTS 5,097,238 A 3/1992 Sato et al. ..... 333/219.1
5,661,441 A * 8/1997 Morino et al. ..... 331/67
5,691,677 A * 11/1997 De Maron et al. ..... 333/219.1
5,798,676 A * 8/1998 Jachowski ..... 333/202
6,064,895 A * 5/2000 Baumfalk et al. ..... 505/210
6,078,231 A * 6/2000 Pelkonen ..... 333/203

FOREIGN PATENT DOCUMENTS

EP 0197653 A2 10/1986

OTHER PUBLICATIONS

European Search Report dated Jun. 6, 2002.
"Highly Stable Microwave Resonator," NASA Tech Brief, Jan. 1988, pp. 14–15, XP–002199085.

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP

(57) ABSTRACT

A dielectric resonance device includes a cavity body, a support base disposed inside the cavity body, and a dielectric core supported by the support base. A stepped portion is provided inside the cavity body such that a gap between the outer circumferential surface of the dielectric core and the inner wall surface of the cavity body and a gap between the peripheral portion of the support-base attachment surface of the dielectric core and the stepped portion change in opposite directions with temperature variation. Thus, variation with temperature in the resonance frequency of a TM01δ mode is suppressed.

14 Claims, 14 Drawing Sheets

DIELECTRIC RESONANCE DEVICE, DIELECTRIC FILTER, COMPOSITE DIELECTRIC FILTER DEVICE, DIELECTRIC DUPLEXER, AND COMMUNICATION APPARATUS

BACKGROUND OF THE INVENTION

1. Field of the Invention

The present invention relates to a dielectric resonance device including a cavity and a dielectric core disposed therein, as well as to a dielectric filter, a composite dielectric filter device, a dielectric duplexer, and a communication apparatus, each of which utilizes the dielectric resonance device.

2. Description of the Related Art

The applicant of the present application has filed Japanese patent application Nos. 10-220371 and 10-220372 for inventions in relation to dielectric resonators which are compact and facilitate formation of a multi-stage resonator. In the dielectric resonators of these applications, a substantially parallelepipedic dielectric core is disposed within a substantially parallelepipedic cavity, and the dielectric core is resonated in multiple modes.

Dielectric resonance devices in which a dielectric core is disposed within a cavity in an isolated manner typically employ a structure such that the dielectric core is supported at a predetermined position within the cavity via a support base. FIGS. 16 and 17 shows an example of the structure, wherein FIG. 16 is an exploded perspective view of a dielectric resonance device, and FIG. 17 is a vertical cross section of the dielectric resonance device at the center thereof. In these drawings, reference numeral 3 denotes a parallelepipedic dielectric core, which is fixed to the bottom surface of a cavity body 1 via a support base 4 of low dielectric constant. A cavity lid 2 is placed on the top opened surface of the cavity body 1.

When the dielectric core 3 of the dielectric resonance device resonates in a $TM01\delta_{-x}$ mode or in a $TM01\delta_{-y}$ mode, the resonance frequency varies with the capacitance which is present between inner walls of the cavity which face end surfaces of the dielectric core 3, as indicated by a symbol of a capacitor in FIG. 17. Therefore, if the linear expansion coefficients of the dielectric core and the support base differ from that of the cavity, the capacitance present between the peripheral surface of the dielectric core and the inner wall of the cavity will vary with temperature, with resultant variation in resonance frequency. The resonance frequency also varies in accordance with the temperature coefficient of the dielectric core.

FIGS. 18A and 18B are graphs showing such variation in resonance frequency. In FIG. 18A, the horizontal axis represents time, and the vertical axis represents variation in resonance frequency relative to the resonance frequency at 25° C. In FIG. 18B, the horizontal axis represents temperature, and the vertical axis represents variation in resonance frequency relative to the resonance frequency at 25° C. In this example, when the temperature of the dielectric resonance device is lowered to −30° C., the resonance frequency of the $TM01\delta_{-x}$ mode and the resonance frequency of the $TM01\delta_{-y}$ mode decrease by 0.5 to 0.6 MHZ, and when the temperature of the dielectric resonance device is raised to +85° C., the resonance frequencies of these two modes increase by 0.7 to 0.8 MHZ.

Although the above-described temperature characteristics of the resonance frequencies can be improved through employment of a material of low linear expansion coefficient, such as invar or 42%-nickel iron alloy, this increases cost. Further, when in addition a TE01δ mode of the dielectric core is utilized in a dielectric resonance device having a structure as shown in FIGS. 16 and 17, the temperature characteristic of this mode raises another problem. That is, the resonance frequency of the TE01δ mode does not relate directly to the capacitance between the peripheral portion of the dielectric core and the inner wall of the cavity but depends on the size of the cavity and the temperature coefficient of the dielectric core. In the example case shown in FIG. 18, the resonance frequency of the TE01δ mode increases by about 0.3 MHZ as a result of a temperature decrease to −30° C. and decreases by about 0.4 MHZ as a result of a temperature increase to +85° C. The directions of these variations are completely opposite those in the case of the $TM01\delta_{-x}$ mode and the $TM01\delta_{-y}$ mode. Accordingly, the above-described TM01δ modes differ from the TE01δ mode in terms of temperature characteristic of the resonance frequency, thereby raising a different problem, that the overall frequency characteristic of the resonance device varies with temperature.

SUMMARY OF THE INVENTION

In view of the foregoing, the present invention provides a dielectric resonance device which has a stabilized temperature characteristic of a TM-mode resonance frequency, which would otherwise vary due to differences in linear expansion coefficient among a dielectric core, a support base, and a cavity.

The invention further provides a dielectric filter, a composite dielectric filter device, a dielectric duplexer, and a communication apparatus, each of which utilizes the dielectric resonance device.

The present invention also provides a dielectric resonance device with reduced variation in the frequency characteristic with temperature in a multi-mode operation utilizing TM and TE modes, as well as a dielectric filter, a composite dielectric filter device, a dielectric duplexer, and a communication apparatus, each of which utilizes the dielectric resonance device.

The present invention provides a dielectric resonance device comprising: an electrically conductive cavity; a dielectric core fixedly disposed within the cavity via a support base, the dielectric core being capable of resonating in a TM mode; and a capacitance-generation electrode having the same electrical potential as that of the cavity and provided at a predetermined position between an inner wall surface on which the support base is fixed and a support-base attachment surface of the dielectric core through which the dielectric core is attached to the support base, such that a capacitance is produced between the electrode and the support-base attachment surface of the dielectric core.

As a result of employment of this structure, when temperature varies, the size of a gap between the peripheral surface of the dielectric core and the inner wall surface of the cavity and the size of a gap between a circumferential portion of the support-base attachment surface of the dielectric core and the electrode change in directions opposite each other. Therefore, variation in the capacitance between the dielectric core and the cavity is suppressed, so that the resonance frequency of the TM mode is stabilized.

The electrode may be a stepped portion which is provided inside the cavity such that a surface of the stepped portion faces a circumferential portion of the support-base attachment surface of the dielectric core.

In this case, since the stepped portion provided inside the cavity serves as an electrode which faces a circumferential portion of the support-base attachment surface of the dielectric core, the characteristics can be improved without increase in the number of components.

Alternatively, the electrode may be an electrically conductive member, for example a plate, attached to the inner wall surface of the cavity such that the conductive member or plate faces a circumferential portion of the support-base attachment surface of the dielectric core.

In this case, since the electrode is provided through attachment of the conductive member or plate, the structure of the cavity before attachment of the conductive member or plate is simple, and therefore the cavity can be fabricated with ease. Further, the characteristics can be switched or adjusted by selectively changing the shape of the conductive member or plate and/or the manner or location of its attachment.

Alternatively, the electrode may be a member such as a screw which projects toward the interior of the cavity.

In this case, the temperature characteristic of the dielectric resonance device can be optimized with ease through adjustment of the screw.

Preferably, the dielectric core resonates in TM01δ and TE01δ modes at substantially the same resonance frequency; and the shapes and sizes of the dielectric core, cavity, and capacitance-generation electrode are determined such that, when temperature varies, the resonance frequency of the TM01δ mode varies in the same direction as that of the resonance frequency of the TE01δ mode. That is, the resonance frequency of the TE01δ mode does not relate directly to the gap between the peripheral surface of the dielectric core and the cavity or to the gap between a circumferential portion of the dielectric core and the capacitance-generation electrode, but, as best understood, is determined by the size of the cavity and the temperature coefficient of the dielectric core. In view of the above, deterioration of the overall frequency characteristic of the dielectric resonance device, which deterioration would otherwise occur due to temperature variation, is suppressed through a design which renders the direction (polarity) of variation with temperature of the resonance frequency of the TM01δ mode the same as that of the resonance frequency of the TE01δ mode.

When the TM01δ mode and the TE01δ mode are used in a multiplex manner, the temperature characteristic of the resonance frequency of the TM01δ mode becomes substantially the same as that of the resonance frequency of the TE01δ mode, so that deterioration of the frequency characteristic due to temperature variation can be prevented.

The present invention also provides a dielectric filter which comprises the above-described dielectric resonance device; and couplings which couple with the dielectric core of the dielectric resonance device and through which signals are input and output.

The present invention further provides a composite dielectric filter device which comprises a plurality of the above-described dielectric filters.

The present invention further provides a dielectric duplexer which comprises first and second filters, wherein an input port of the first filter is used as a transmission signal input port, an output port of the second filter is used as a reception signal output port, and a common input/output port of the first and second filters is used as an antenna port.

The dielectric filter, the composite dielectric filter device, and the dielectric duplexer of the present invention exhibit excellent stability in terms of frequency characteristic against temperature variation.

The present invention further provides a communication apparatus which comprises the dielectric filter, the composite dielectric filter device, or the dielectric duplexer and which serves as, for example, a communication apparatus at a base station of a mobile communication system.

The communication apparatus of the present invention exhibits excellent stability in terms of communication characteristics against temperature variation, and can be used in a widened temperature range.

Other features and advantages of the present invention will become apparent from the following description of the invention which refers to the accompanying drawings.

DESCRIPTION OF EMBODIMENTS OF THE INVENTION

The structure of a dielectric resonance device according to a first embodiment of the present invention will be described with reference to FIGS. 1 to 7.

Figure 1:
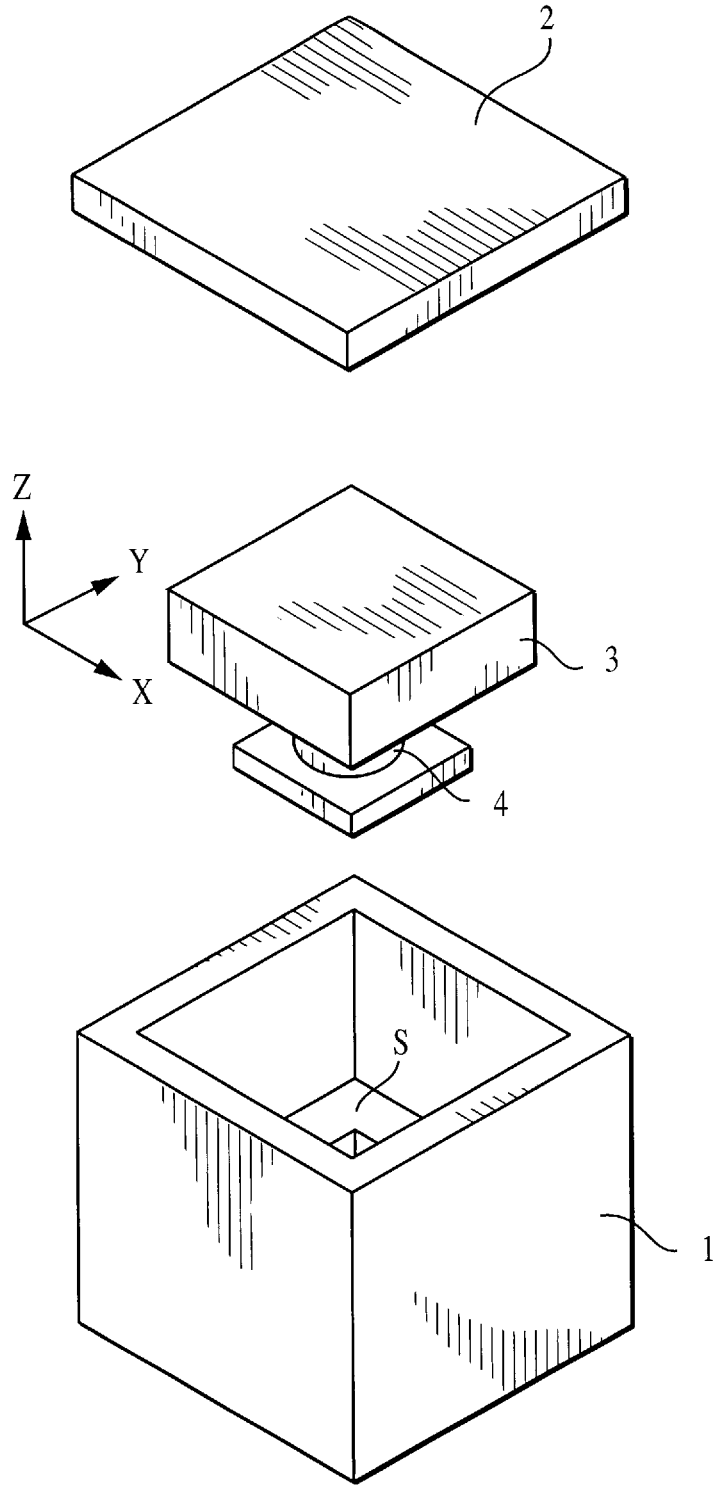
FIG. 1 is an exploded perspective view of a dielectric resonance device according to a first embodiment of the present invention.
Figure 2A:
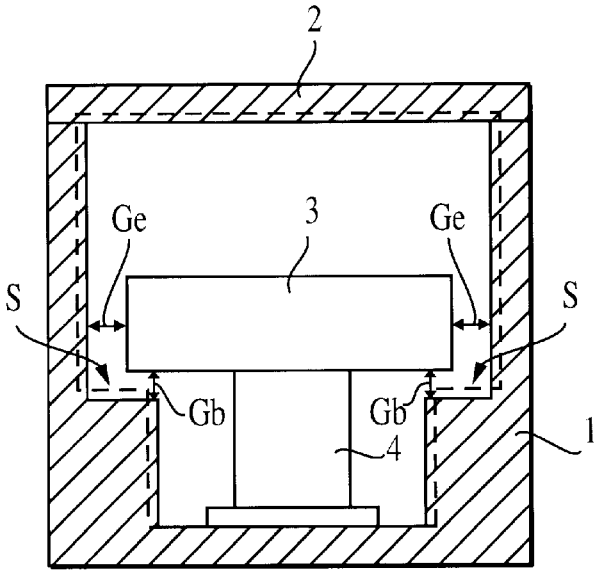
FIGS. 2A and 2B are each a vertical cross section of the dielectric resonance device.
Figure 2B:
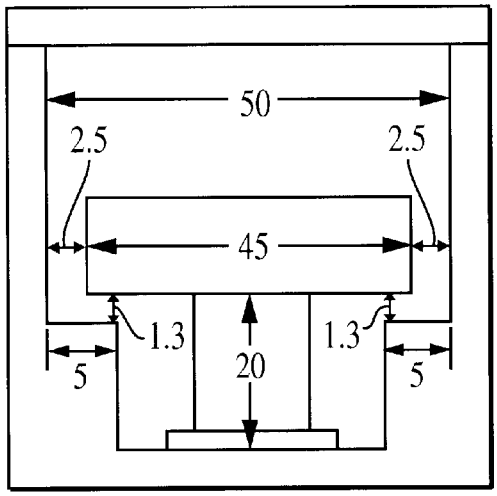

FIG. 1 is an exploded perspective view of the dielectric resonance device; and FIGS. 2A and 2B are each a vertical cross section of the dielectric resonance device at the center thereof. In these drawings, reference numeral 3 denotes a substantially parallelepipedic dielectric core formed of a dielectric material. Reference numeral 1 denotes a cavity body formed of a metal, and 2 denotes a cavity lid which is formed of a metal and covers the open face of the cavity body 1. The dielectric core 3 is bonded to the inner bottom face of the cavity body 1 via a support base 4. The bonding between the support base 4 and the dielectric core 3 is effected by use of adhesive or by means of baking. The cavity lid 2 is fixed to the open face of the cavity body 1 by use of screws (in the drawings, screws and tapped holes are omitted). It is to be noted that instead of being formed from metal, the cavity body 1 and the cavity lid 2 may be formed from any base material, such as ceramic or resin, other than metal. In this case, electrically conductive film is formed on the base material.

A stepped portion S is formed on the inner wall surface of the cavity body 1. In this structure, a gap Ge is formed between the peripheral surface of the dielectric core 3 and the inner wall surface of the cavity body 1; and a gap Gb is formed between a support-base attachment surface of the dielectric core 3 (the lower surface of the dielectric core 3 in the drawings) and the stepped portion S of the cavity body 1.

FIG. 2B shows the dimensions in mm of respective portions shown in FIG. 2A. The size of the inner space of the cavity excluding the stepped portion is 50×50 ×50 mm; and the size of the dielectric core 3 is 45×4×7 mm.

Figure 4:
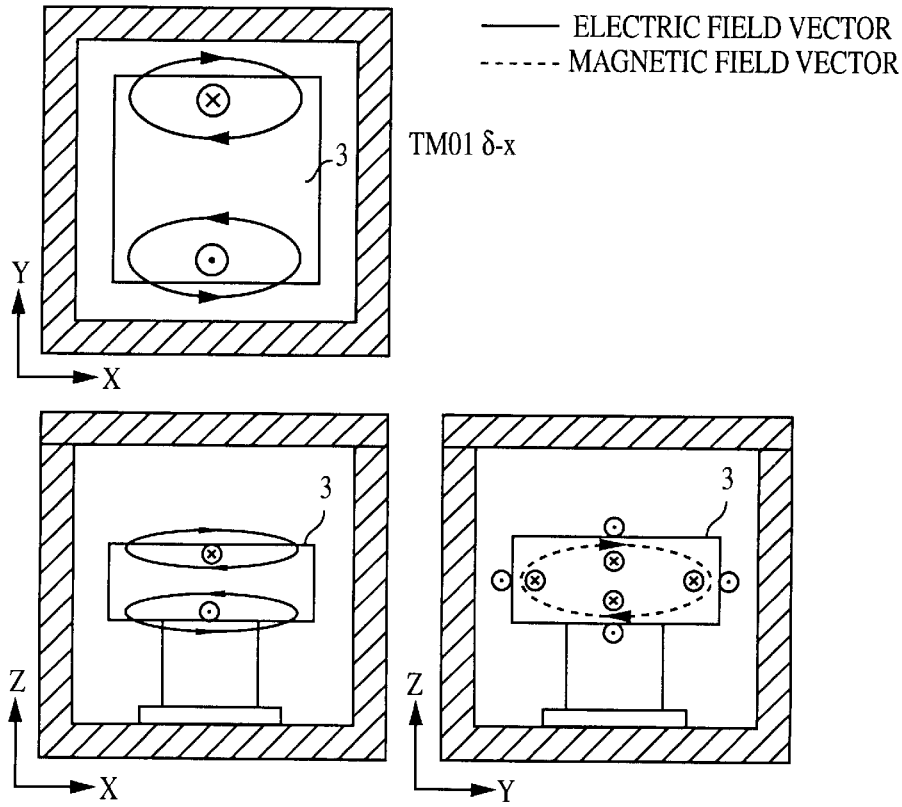
FIG. 4 is a view showing an example of distribution of electromagnetic fields in the dielectric resonance device in a $TM01\delta_{-x}$ mode.
Figure 5:
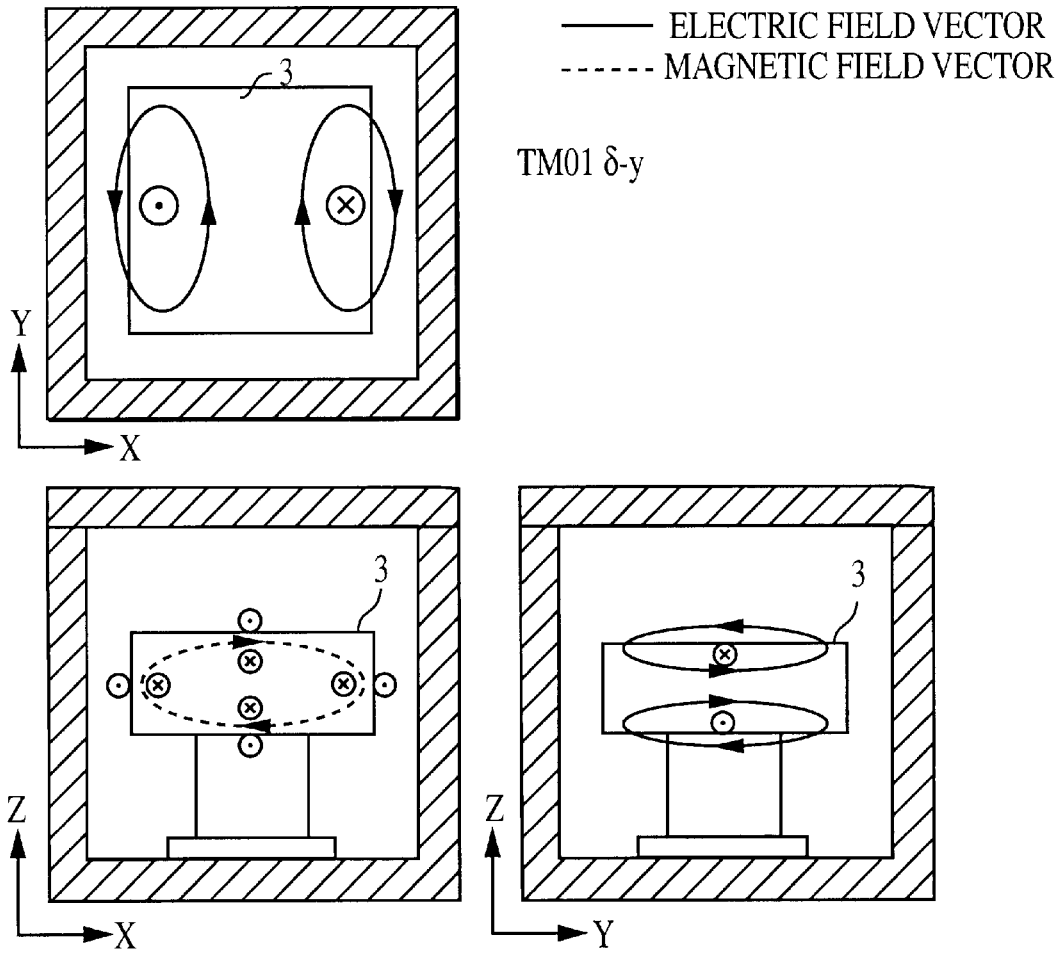
FIG. 5 is a view showing an example of distribution of electromagnetic fields in the dielectric resonance device in a $TM01\delta_{-y}$ mode.

FIG. 4 shows an example distribution of electromagnetic fields produced in the dielectric core in a $TM01\delta_{-x}$ mode. FIG. 5 shows an example distribution of electromagnetic fields produced in the dielectric core in a $TM01\delta_{-y}$ mode. In these drawings, a solid-lined arrow indicates an electric field vector; a broken-lined arrow indicates a magnetic field vector; and dot and x symbols indicate directions of electric or magnetic fields. The TM mode is generally represented by TMθrh, where θ, r, and h represent the number of waves in the electromagnetic-field strength distribution in the circumferential, radial, and propagation directions, respectively. Further, a direction of propagation is represented by use of a subscript. Accordingly, in the $TM01\delta_{-x}$ mode, a magnetic field vector forms a loop parallel to the y-z plane of the dielectric core, and in the $TM01\delta_{-y}$ mode, a magnetic field vector forms a loop parallel to the x-z plane of the dielectric core. The symbol "δ" represents a value less than 1 or represents a state in which the direction of waves does coincide perfectly with the propagation direction, but the strength varies in the propagation direction.

When the cavity body 1 is formed of aluminum, the dielectric core 3 is formed of a dielectric ceramic, and the support base 4 is formed of an insulating ceramic, the linear expansion coefficient of the cavity is generally greater than those of the dielectric core 3 and the support base 4. Therefore, as the temperature of the dielectric resonance device increases, the inner wall surface of the cavity body 1 displaces as indicated by a broken line in FIG. 2A. As a result, the gap Ge between the peripheral surface of the dielectric core and the inner wall surface of the cavity increases, and the gap Gb between the support-base attachment surface of the dielectric core 3 and the stepped portion S decreases. On the contrary, when the temperature of the dielectric resonance device decreases, the gap Ge decreases, and the gap Gb increases. Accordingly, variation in the capacitance produced at the gap Ge and variation in the capacitance produced at the gap Gb cancel each other out, so that variation with temperature in the resonance frequency of the TM01δ mode can be suppressed.

Figure 3:
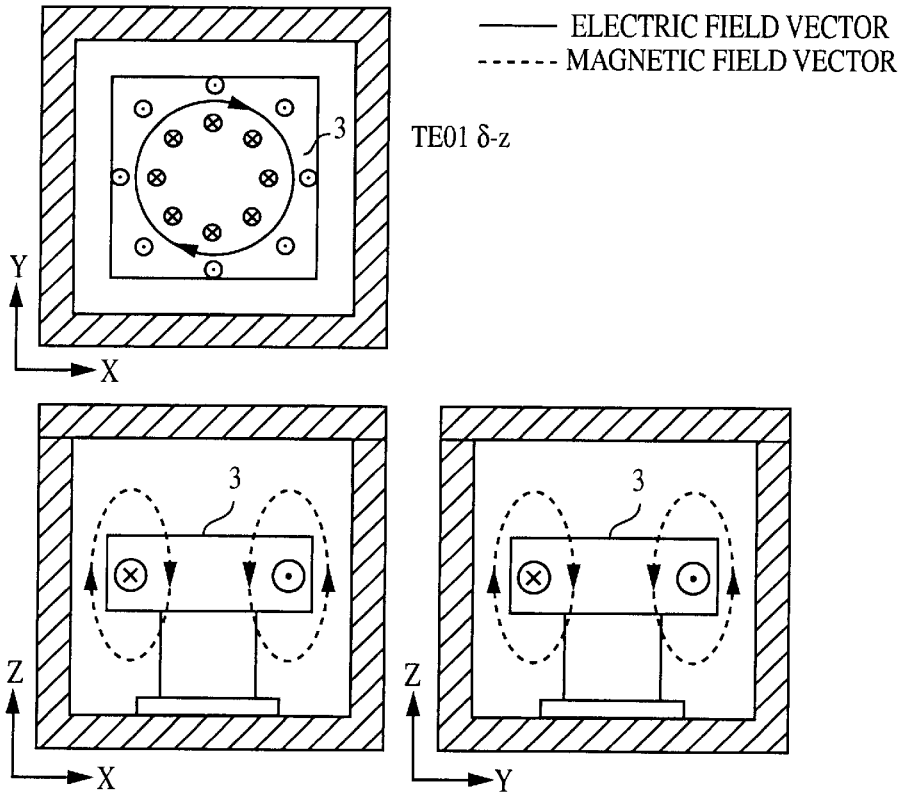
FIG. 3 is a view showing an example of distribution of electromagnetic fields in the dielectric resonance device in a $TE01\delta_{-z}$ mode.

FIG. 3 shows a distribution of electromagnetic fields produced in the dielectric core in a $TE01\delta_{-z}$ mode. In this drawing, a solid-lined arrow indicates an electric field vector; a broken-lined arrow indicates a magnetic field vector; and dot and x symbols indicate directions of electric or magnetic fields. Since in the TE01δ mode most electric field energy is confined within the dielectric core, the resonance frequency is not affected by the capacitance present between the vicinity of the outer circumference of the dielectric core and the inner wall surface of the cavity. Therefore, the resonance frequency of the TE01δ mode varies depending on the size of the space of the cavity within which the magnetic field exists and the temperature coefficient Tf (a coefficient of variation in dielectric constant with temperature).

Figure 6A:
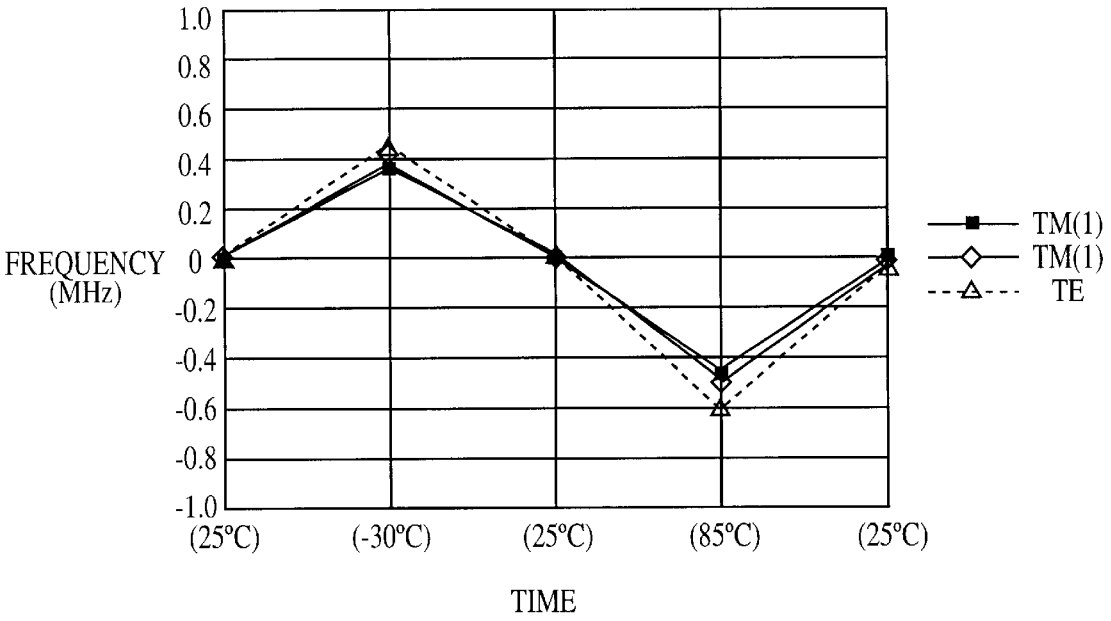
FIGS. 6A and 6B are graphs showing an example of how resonance frequencies vary with temperature in the dielectric resonance device in respective resonance modes.
Figure 6B:
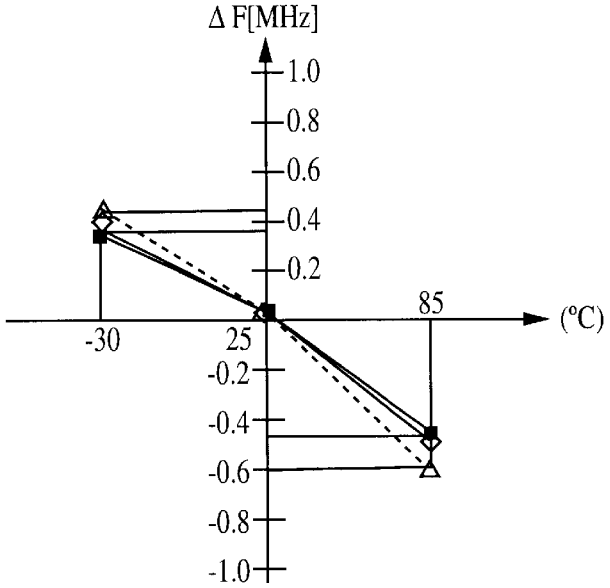

FIGS. 6A and 6B are graphs showing the temperature characteristics of the resonance frequencies of the above-described three modes. In FIG. 6A, the horizontal axis represents time, and the vertical axis represents variation in resonance frequency relative to the resonance frequency at 25° C. In this example, the resonance frequencies of the TM01δ modes change by +0.4 MHZ when the temperature of the dielectric resonance device is lowered to −30° C., and change by −0.5 MHZ when the temperature of the dielectric resonance device is raised to +85° C. By contrast, the resonance frequency of the TE01δ mode changes by +0.5 MHZ as a result of a temperature decrease to −30° C. and changes by about −0.6 MHZ as a result of a temperature increase to +85° C. As described above, the temperature characteristics of the resonance frequencies of the TM01δ modes are made substantially equal to that of the TE01δ mode. Thus, the overall variation with temperature in the frequency characteristic of the dielectric resonance device is suppressed.

The above-described example is for the case in which the dielectric core is formed of a dielectric material of Tf (temperature coefficient)=0. However, when the dielectric resonance device is designed such that frequency variation due to the temperature coefficient Tf of the dielectric core and frequency variation due to deformation of the cavity cancel each other out, the dielectric resonance device always exhibits a constant frequency characteristic regardless of the temperature.

Electric field energy accumulated within the dielectric core varies depending on the resonance mode. If this phenomenon is taken into consideration, the stability of the frequency characteristic against temperature variation can be improved further. Specifically, the percentage of electric field energy accumulated within the dielectric core is 100% in the case of the TE01δ mode and 60% in the case of the TM01δ mode. Therefore, the frequency variation due to the temperature coefficient Tf of the dielectric core in the TM01δ modes is 60% that in the TE01δ mode. In view of the above, the shape, dimensions, and material of the dielectric core as well as the shape and dimensions of the cavity are determined such that the frequency variation due to deformation of the cavity stemming from temperature variation in the TM01δ modes becomes 60% that in the TE01δ mode.

Figure 7A:
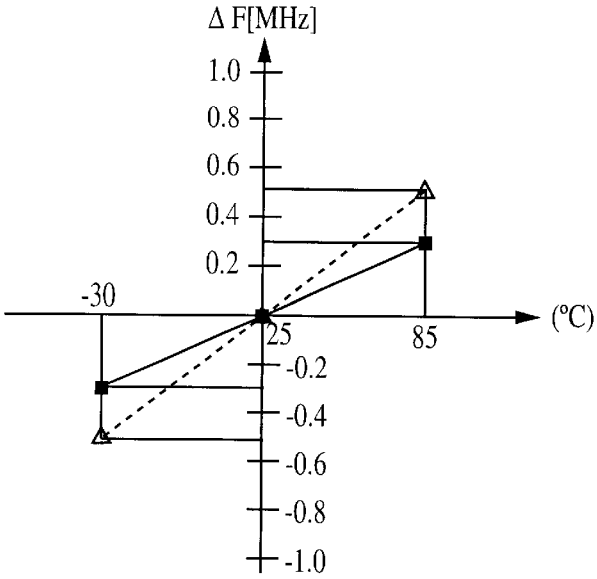
FIGS. 7A to 7C are graphs showing another example of how resonance frequencies vary with temperature in the dielectric resonance device in respective resonance modes.
Figure 7B:
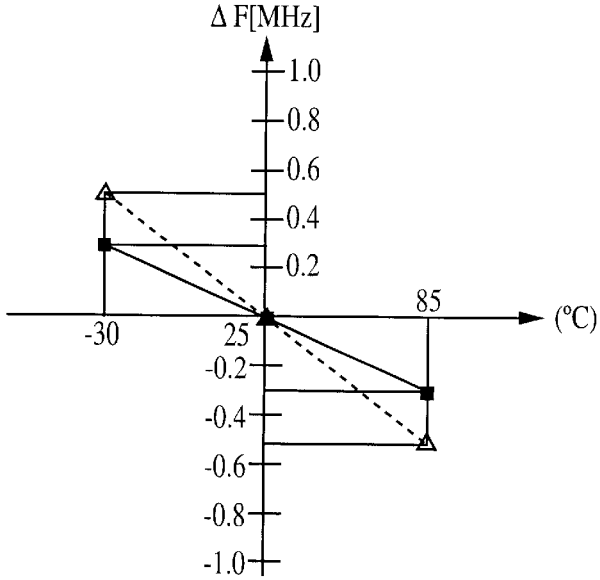
Figure 7C:
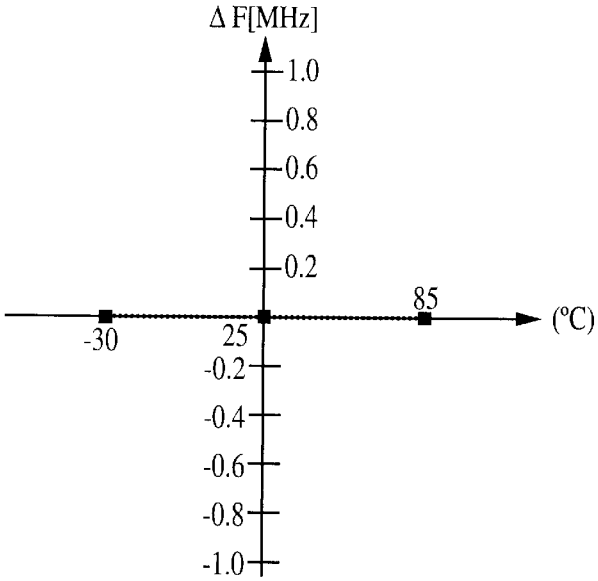

FIGS. 7A to 7C show an example of a set of frequency variations, in which FIG. 7A shows frequency variation due to the temperature coefficient Tf of the dielectric core; FIG. 7B shows frequency variation due to deformation of the cavity; and FIG. 7C shows a characteristic of frequency variation obtained through addition of the frequency variations of FIGS. 7A and 7B. In these drawings, the horizontal axis represents temperature, and the vertical axis represents variation in resonance frequency relative to resonance frequency at 25° C. Here, the gap Gb shown in FIG. 2 is set to 1.5 mm, which is greater than that in the case in which the characteristics shown in FIGS. 6A and 6B are obtained.

The temperature coefficient Tf of the dielectric core used here is 4.4 ppm/° C. As shown in FIG. 7A, due to this temperature coefficient, the resonance frequency of the TE01δ mode changes by −0.5 MHZ as a result of a temperature decrease to 30° C., and changes by +0.5 MHZ as a result of a temperature increase to +85° C.; and the resonance frequencies of the TM01δ modes change by −0.3 MHZ as a result of a temperature decrease to −30° C. and change by about +0.3 MHZ as a result of a temperature increase to +85° C. In consideration of these frequency variations, the size of the cavity and the size and dielectric constant of the dielectric core are determined such that, due to deformation of the cavity, the resonance frequency of the TE01δ mode changes by +0.5 MHZ as a result of a temperature decrease to 30° C., and changes by −0.5 MHZ as a result of a temperature increase to +85° C. Further, the sizes of the gaps Ge and Gb shown in FIG. 2A as well as opposed areas at the gaps Ge and Gb are determined such that the resonance frequencies of the TM01δ modes change by +0.3 MHZ as a result of a temperature decrease to −30° C., and change by −0.3 MHZ as a result of a temperature increase to +85° C. (i.e., variation in the resonance frequencies of the TM01δ modes due to deformation of the cavity becomes 60% that of the TE01δ mode).

Through the above-described design, the overall temperature characteristic of the resonance frequencies of the respective modes becomes equal to that obtained through combination of the characteristic of FIG. 7A and the characteristic of FIG. 7B, so that the overall temperature characteristic becomes constant as shown in FIG. 7C.

The structure of a dielectric filter according to a second embodiment of the present invention will be described with reference to FIGS. 8A to 8C and FIG. 9.

Figure 8A:
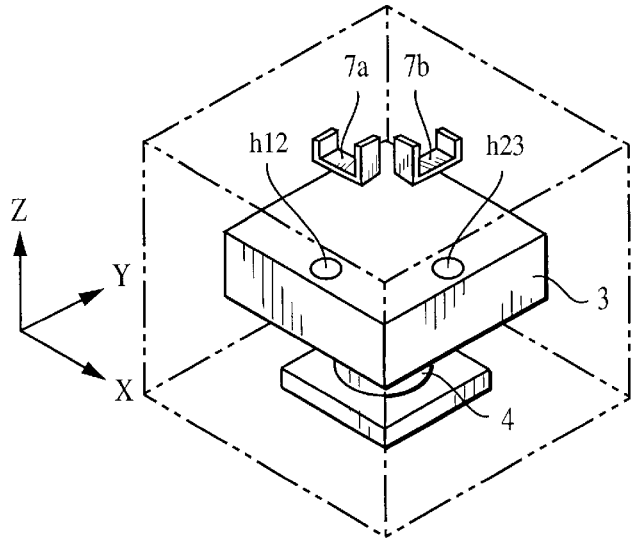
FIGS. 8A to 8C are views showing the structure of a dielectric filter according to a second embodiment of the present invention.

The dielectric filter differs from the dielectric resonance device of the first embodiment in that couplings for establishing coupling with resonance modes are added. FIG. 8A shows the positional relationship between the dielectric core and coupling loops serving as couplings. Two-dot chain lines schematically show the shape of the cavity. The structure of the cavity and the support structure of the dielectric core are the same as those used in the first embodiment.

Figure 8B:
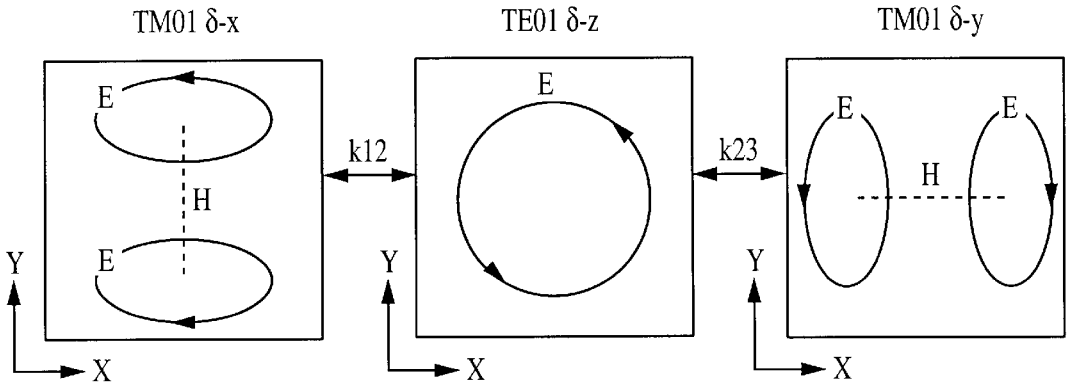
Figure 8C:
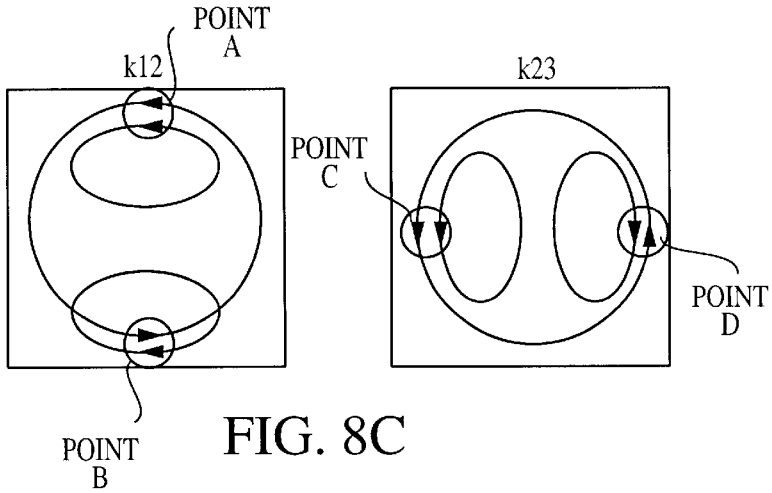

FIG. 8B shows the electromagnetic field distributions of three resonance modes of the dielectric filter. FIG. 8C shows inter-stage couplings when the three resonance modes are used as a three-stage resonator. A coupling loop 7*a* shown in FIG. 7A establishes magnetic-field coupling with the $TM01\delta_{-x}$ mode, and a coupling loop 7*b* shown in FIG. 7A establishes magnetic-field coupling with the $TM01\delta_{-y}$ mode. One end of each of the coupling loops 7*a* and 7*b* is connected to the cavity, and the other end is connected to, for example, a center conductor of a coaxial connector.

Coupling adjustment holes h12 and h23 are formed in the dielectric core 3. As shown in the left-hand drawing in FIG. 8C, energy moves from the $TM01\delta_{-x}$ mode to the $TE01\delta_{-z}$ mode through breakage of the balance in electric field strength between points A and B. Through utilization of this phenomenon, the coupling coefficient k12 between the resonators in the first and second stages is determined by the size of the coupling adjustment hole h12. Similarly, as shown in the right-hand drawing in FIG. 8C, energy moves from the $TE01\delta_{-z}$ mode to the $TM01\delta_{-y}$ mode through breakage of the balance in electric field strength between points C and D. Through utilization of this phenomenon, the coupling coefficient k23 between the resonators in the second and third stages is determined by the size of the coupling adjustment hole h23.

Figure 9:
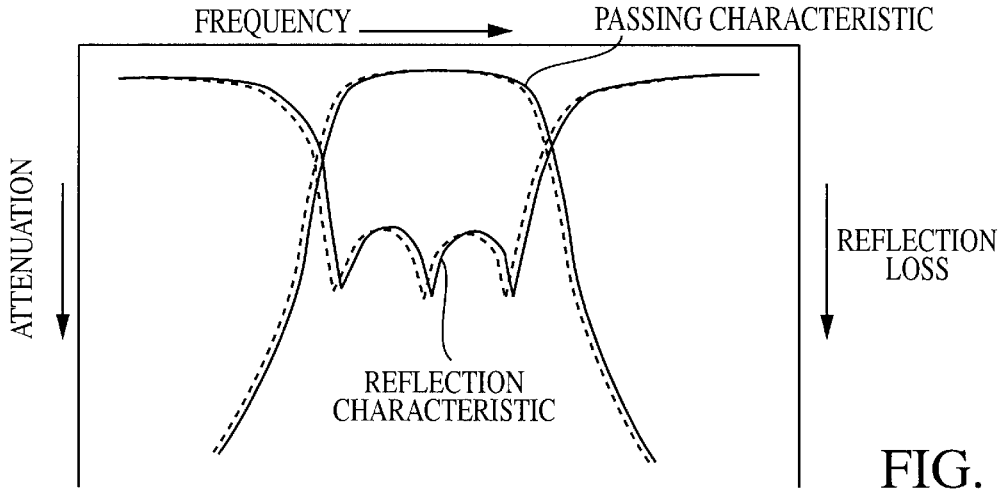
FIG. 9 is a graph showing the frequency characteristic of the dielectric filter.

In this manner, a bandpass-type dielectric filter composed of three resonators can be constructed. FIG. 9 shows the frequency characteristic of the above-described dielectric filter. When the temperature of the dielectric filter changes, the resonance frequencies of the resonators in the three stages change in the same direction. Therefore, a curve indicating the passing characteristic and a curve indicting the reflection characteristic shift a short distance along the frequency axis, while maintaining their profiles. When the temperature characteristics of the resonance frequencies of the above-described three modes are the same as those shown in FIGS. 6A and 6B, the center frequency of the pass band shifts toward lower frequency as the temperature of the dielectric filter increases. When, as described in the first embodiment, the resonance frequencies of the above-described three modes exhibit an overall temperature characteristic as shown in FIG. 7C, the dielectric filter exhibits substantially constant passing and reflection characteristics over a wide temperature range, irrespective of variation in the temperature of the dielectric filter.

Figure 10:
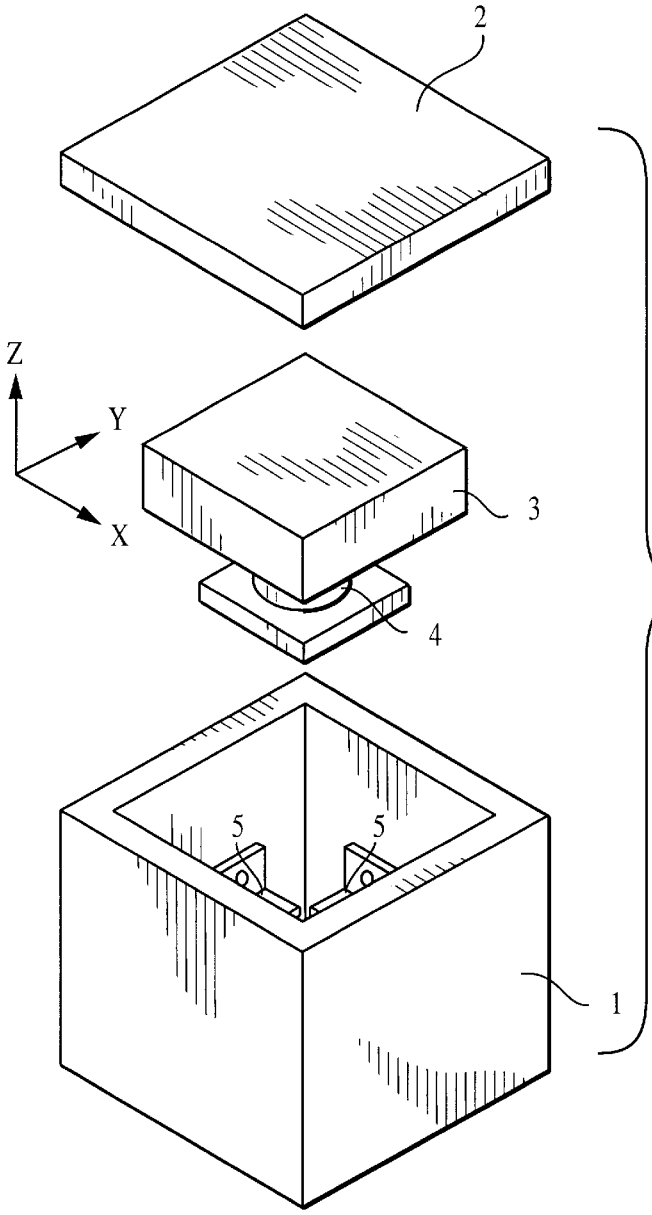
FIG. 10 is an exploded perspective view of a dielectric resonance device according to a third embodiment of the present invention.
Figure 11:
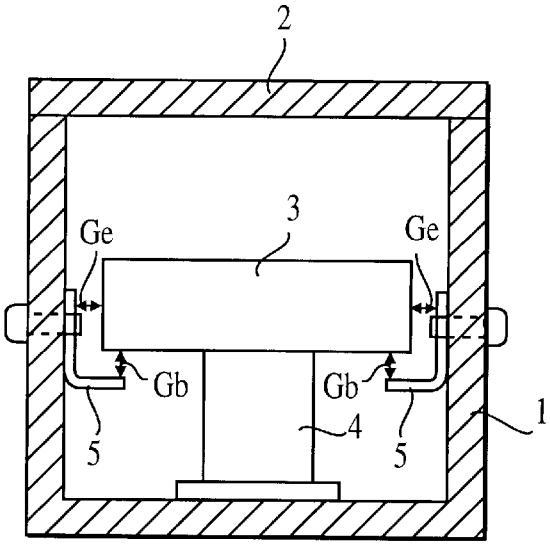
FIG. 11 is a vertical cross section of the dielectric resonance device.

Next, the structure of a dielectric resonance device according to a third embodiment of the present invention will be described with reference to FIGS. 10 and 11.

In the first embodiment, a stepped portion is formed inside the cavity in order to produce a capacitance between the surface of the stepped portion and the peripheral portion of the dielectric core. However, as shown in FIGS. 10 and 11, instead of the stepped portion, conductor plates may be provided on the inner wall surface of the cavity. FIG. 10 is an exploded perspective view of the dielectric resoancedevice; and FIG. 11 is a vertical cross section of the dielectric resonance device at the center thereof In these drawings, reference numeral 5 denotes conductor plates attached to the inner wall surface of the cavity body 1. That is, a capacitance is produced at each gap Gb between the peripheral portion of the support-base attachment surface of the dielectric core 3 and the corresponding conductive plate 4.

Even when conductive plates are provided as capacitance generation electrodes, the size of the gap Ge changes in a direction opposite the direction of change in the size of the gap Gb, as in the case in which a stepped portion is provided within the cavity. Therefore, variation in the capacitance produced between the vicinity of the peripheral portion of the dielectric core and the inner wall surface of the cavity is suppressed, with the result that the temperature coefficient of the resonance frequencies of the TM01δ modes is decreased.

Next, the structure of a dielectric resonance device according to a fourth embodiment of the present invention will be described with reference to FIG. 12.

Figure 12:
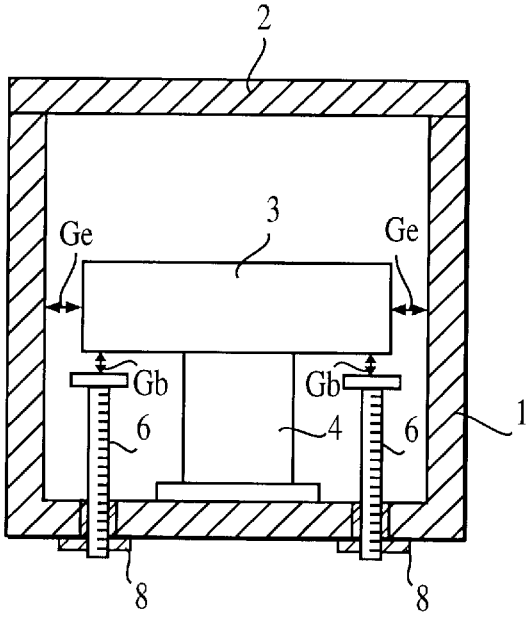
FIG. 12 is a vertical cross section of a dielectric resonance device according to a fourth embodiment of the present invention.

FIG. 12 is a vertical cross section of the dielectric resonance device at the center thereof. In FIG. 12, reference numeral 3 denotes a substantially parallelepipedic dielectric core which is bonded to the inner bottom face of a cavity body 1 via a support base 4. A cavity lid 2 is attached to the top open face of the cavity body 1. In the present embodiment, bushes 8 each having a tapped hole are attached to the bottom wall of the cavity body 1, and screws 6 are screwed into the bushes 8. The top portion of each screw 6 has a flat top surface, in order to increase the capacitance produced between the support-base attachment surface (lower surface) of the dielectric core 3 and the top portion of each screw 6.

This structure provides the following advantageous effects. Even when the linear expansion coefficients of the cavity body 1 and the screws 6 are greater than those of the dielectric core 3 and the support base 4 and when the temperature of the dielectric resonance device changes, the temperature characteristics of the resonance frequencies of the TM01δ modes can be made to substantially coincide with those of the TE01δ mode, because the size of the gap Ge between the circumferential portion of the lower surface of the dielectric core 3 and the inner wall surface of the cavity body 1 changes in a direction opposite the direction of change in the size of the gap Gb between the support-base attachment surface of the dielectric core 3 and the top potion of the screw 6. Thus, variation in the frequency characteristic due to variation in the temperature of the dielectric resonance device can be suppressed.

Further, through employment of the structure which enables easy adjustment of the size of the gap between the dielectric core and the capacitance generation electrode, the degree of the canceling-out action between variation in the capacitance at the gap Ge and variation in the capacitance at the gap Gb can be adjusted through adjustment of the size of the gap Gb.

In the embodiment shown in FIG. 12, the gaps between the circumferential portion of the lower surface of the dielectric core and the screws are adjusted through rotation of the screws. However, the above-described structure may be modified as follows. Screws are attached to the vertical wall of the cavity body 1 such that each screw faces the circumferential portion of the lower surface of the dielectric core; and the opposed area in which each screw faces the lower surface of the dielectric core is adjusted through rotation of the screw in order to adjust the capacitance therebetween.

Figure 13A:
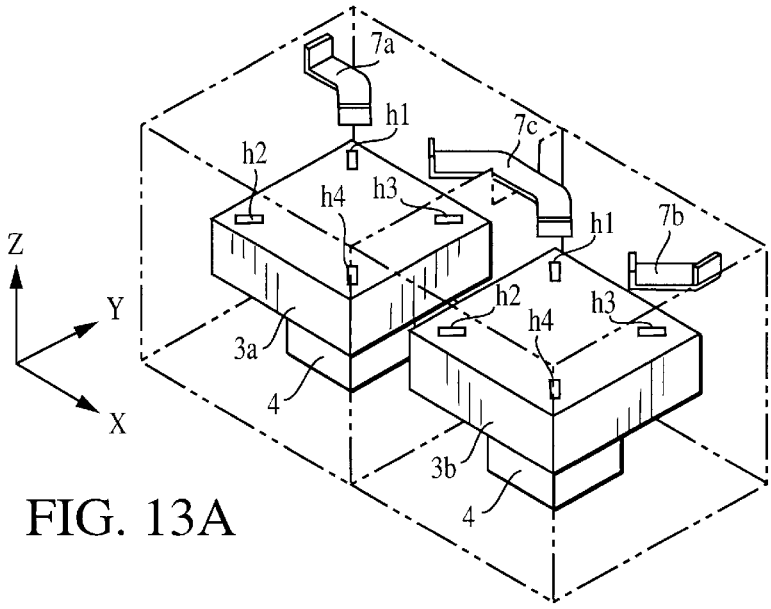
FIGS. 13A to 13C are views showing the structure of a dielectric filter according to a fifth embodiment of the present invention.
Figure 13B:
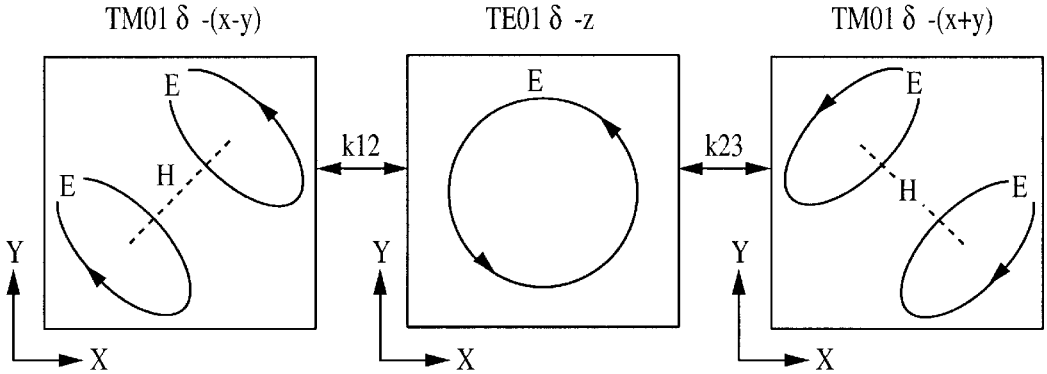
Figure 13C:
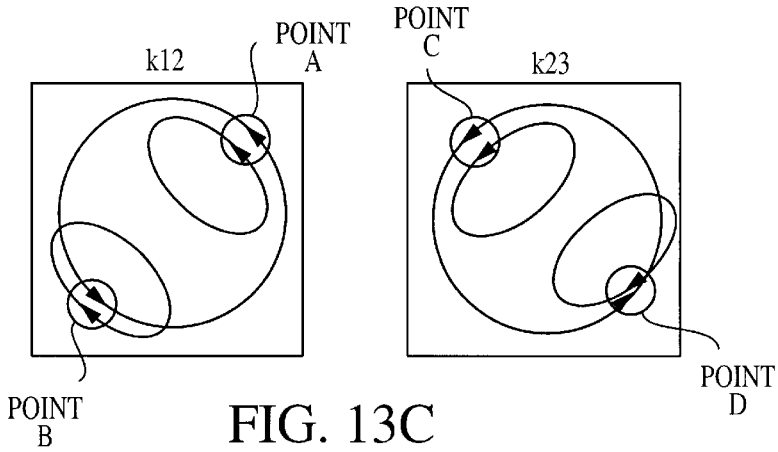

Next, a dielectric filter according to a fifth embodiment of the present invention will be described with reference to FIGS. 13A to 13C. In FIG. 13A, reference numerals 3*a* and 3*b* each denote a dielectric core having a square-plate-like shape in which sides along two axes have substantially the same length, and the side along the remaining axis is shorter than the two sides. Each of the dielectric cores 3*a* and 3*b* is used as a triple-mode dielectric resonator. Two-dot chain lines schematically show the shape of the cavity. The structure of the cavity and the support structure of the dielectric core are the same as those used in the first embodiment. In the present embodiment, as shown in FIG. 13B, three modes; i.e., $TM01\delta_{-(x-y)}$ mode, $TE01\delta_{-z}$ mode, and $TM01\delta_{-(x+y)}$ mode, are used. FIG. 13C shows interstage couplings when the three resonance modes are used as a three-stage resonator.

Reference numerals 7*a* to 7*c* each denote a coupling loop. One end of the coupling loop 7*a* is connected to the cavity, and the other end is connected to, for example, a center conductor of a coaxial connector (not shown). The coupling loop 7*a* is disposed such that the magnetic field (lines of magnetic force) of the $TM01\delta_{-(x-y)}$ mode produced by the dielectric core 3*a* passes through the loop surface of the coupling loop 7*a*. Thus, the coupling loop 7*a* establishes magnetic-field coupling with the $TM01\delta_{-(x-y)}$ mode of the dielectric core 3*a*. The vicinity of one end portion of the coupling loop 7*c* is extended in a direction for establishing magnetic-field coupling with the $TM01\delta_{-(x-y)}$ mode of the dielectric core 3*a*, and the vicinity of the other end portion of the coupling loop 7*c* is extended in a direction for establishing magnetic-field coupling with the $TM01\delta_{-(x-y)}$ mode of the dielectric core 3*b*. The opposite ends of a coupling loop 7*c* are connected to the cavity. The vicinity of one end portion of a coupling loop 7*b* extends in a direction for establishing magnetic-field coupling with the $TM01\delta_{-(x+y)}$ mode of the dielectric core 3*b*, and the other end portion of the coupling loop 7*b* is connected to, for example, a center conductor of a coaxial connector (not shown).

Coupling adjustment holes h1 to h4 are formed in each of the dielectric cores 3*a* and 3*b* each serving as a triple-mode dielectric resonator. As shown in FIG. 13C, energy is caused to move from the $TM01\delta_{-(x-y)}$ mode to the $TE01\delta_{-z}$ mode through breakage of the balance between the coupling adjustment holes h2 and h3, and energy is caused to move from the $TM01\delta_{-z)}$ mode to the $TE01\delta_{-(x+Y)}$ mode through breakage of the balance between the coupling adjustment holes h1 and h4. Thus, each of the dielectric cores 3*a* and 3*b* constitutes a resonator circuit in which resonators in three stages are connected in series. Accordingly, as a whole, the dielectric filter operates as a dielectric filter in which resonators in six stages are connected in series.

Figure 14:
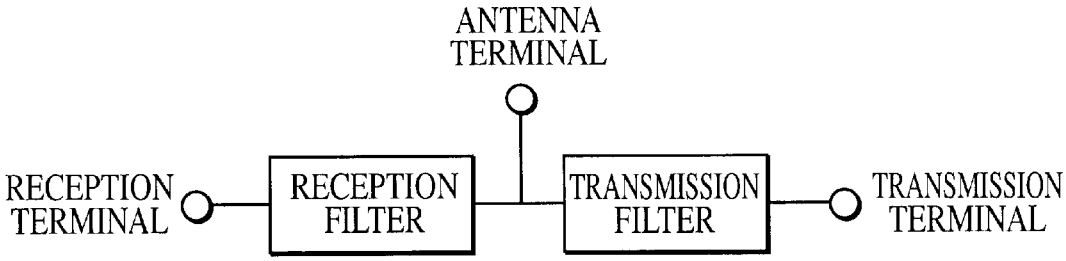
FIG. 14 is a block diagram showing the configuration of a dielectric duplexer.

Next, an example structure of a duplexer will be described with reference to FIG. 14. Each of a transmission filter and a reception filter shown in FIG. 14 is a bandpass filter composed of one of the above-described dielectric filters. The transmission filter allows passage of transmission signals of a certain transmission frequency, and the reception filter allows passage of reception signals of a certain reception frequency. The connection point at which the output port of the transmission filter is connected to the input port of the reception filter is determined to satisfy a requirement that the electrical distance between the connection point and an equivalent short-circuited face of a resonator in the final stage of the transmission filter becomes equal to an odd multiple of ¼ of the wavelength at the reception frequency, and a requirement that the electrical distance between the connection point and an equivalent short-circuited face of a resonator in the first stage of the reception filter becomes an odd multiple of ¼ of the wavelength at the transmission frequency. Thus, the transmission signals and the reception signals are reliably separated from each other.

A duplexer or multiplexer can be formed in a manner similar to that described above; i.e., through disposition of a plurality of dielectric filters between a common port and individual ports.

Figure 15:
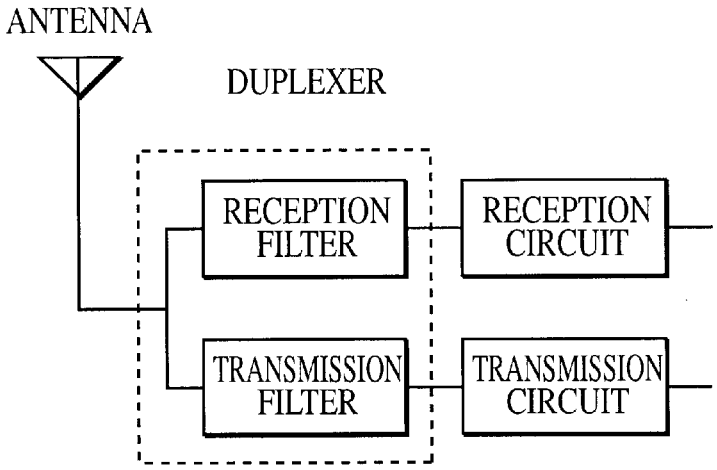
FIG. 15 is a block diagram showing the configuration of a communication apparatus.
Figure 16:
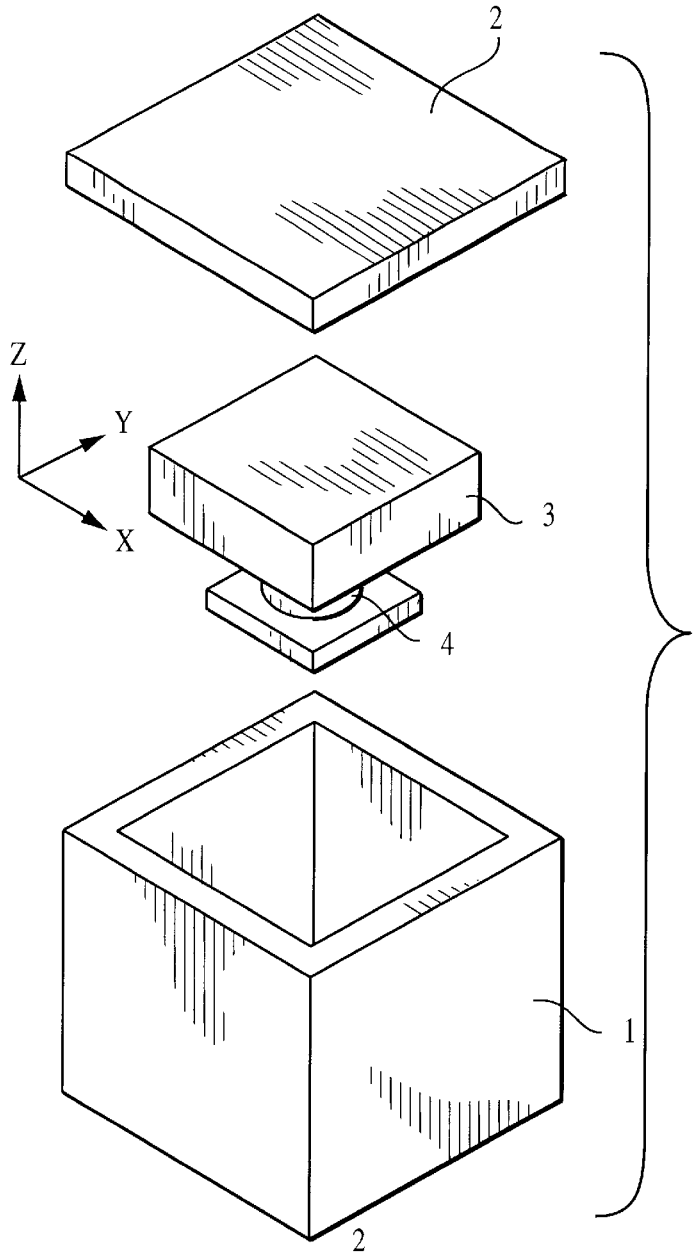
FIG. 16 PRIOR ART
FIG. 16 is an exploded perspective view showing the structure of a conventional dielectric resonance device.
Figure 17:
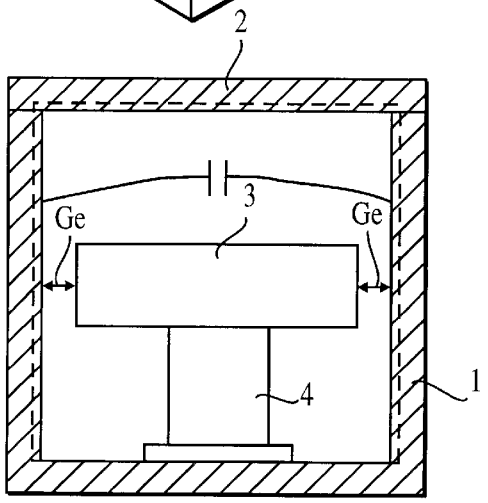
FIG. 17 PRIOR ART
FIG. 17 is a vertical cross section of the conventional dielectric resonance device.
Figure 18A:
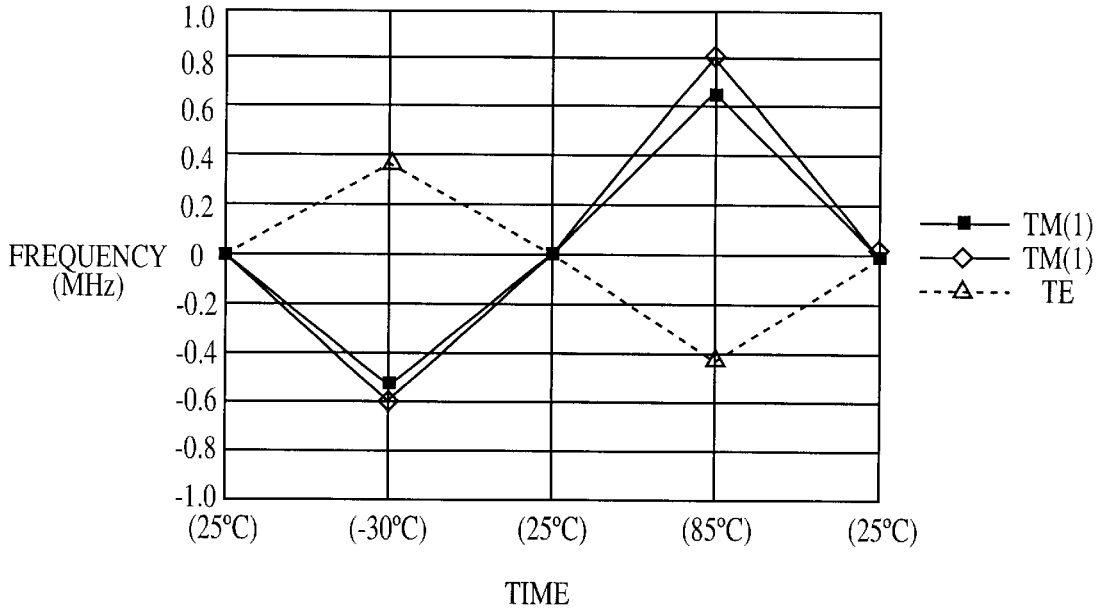
FIG. 18A PRIOR ART
FIGS. 18A and 18B are graphs showing an example of variations with temperature in resonance frequencies of the conventional dielectric resonance device in respective resonance modes.
Figure 18B:
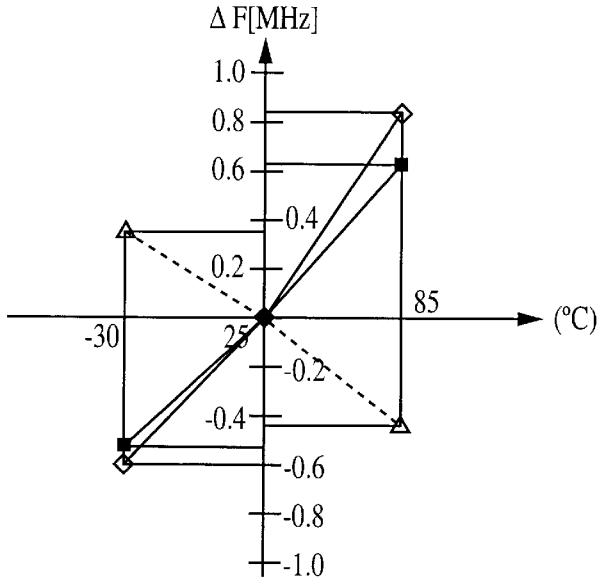
FIG. 18B PRIOR ART
Figure 19:
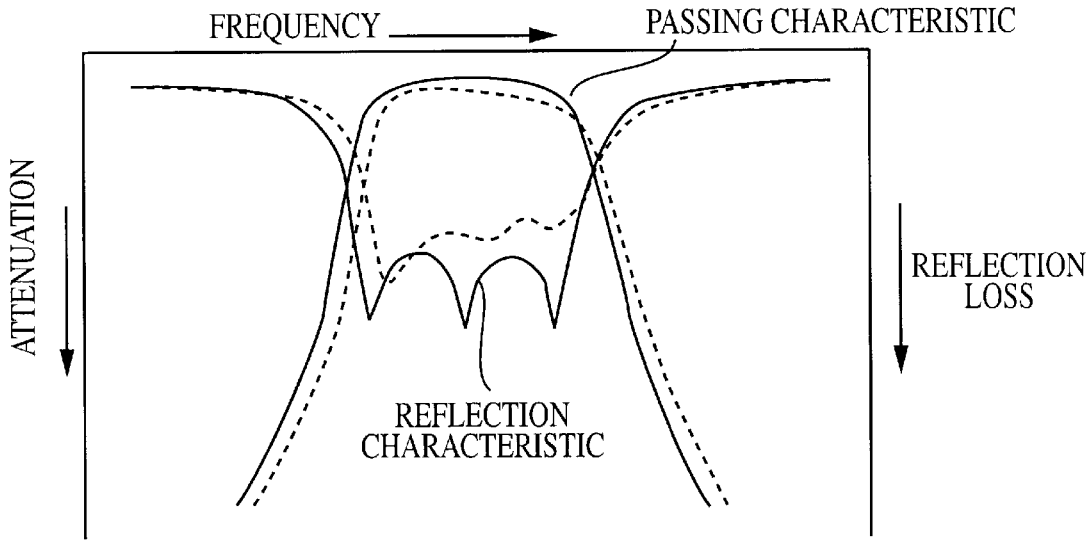
FIG. 19 PRIOR ART
FIG. 19 is a graph showing the frequency characteristic of a conventional dielectric filter.

FIG. 15 is a block diagram showing the structure of a communication apparatus utilizing the above-described duplexer. As shown in FIG. 15, a transmission circuit is connected to the input port of the transmission filter; a reception circuit is connected to the output port of the reception filter; and an antenna is connected to the input/output port of the duplexer. Thus, a high-frequency section of a communication apparatus is constructed.

In addition, various circuit elements, such as a duplexer, a multiplexer, a mixer, and a distributor, may be constructed by use of the above-described dielectric resonator devices, and a communication apparatus may be constructed by use of such circuit elements. The thus-constructed communication apparatus exhibits desired communications characteristics over a wide temperature range.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric resonance device comprising:

an electrically conductive cavity;

a dielectric core fixedly disposed within the cavity via a support base, the dielectric core being capable of resonating in a TM mode;

the dielectric core having an attachment surface whereby the dielectric core is attached to the support base by at least a portion of the attached surface, and a capacitance-generation electrode having the same electrical potential as that of the cavity and provided at a predetermined position between an inner wall surface of the cavity and the attachment surface of the dielectric core such that a capacitance is produced between the electrode and the attachment surface of the dielectric core, further wherein the dielectric core resonates in TM01δ and TE01δ modes at substantially the same resonance frequency; and the shapes, sizes, and materials of the dielectric core, cavity, and capacitance-generation electrode are determined such that, when temperature varies, the resonance frequency of the TM01δ mode varies in the same direction as that of the resonance frequency of the TE01δ mode.

2. A dielectric resonance device according to claim 1, wherein the capacitance-generation electrode is formed by a surface of a stepped internal portion of the cavity.

3. A dielectric resonance device according to claim 2; wherein electric energy accumulation in said dielectric core in said TM01δ mode is a predetermined proportion of that in said TE01δ mode; and the shapes, sizes and materials of said dielectric core and cavity are determined such that a relative contribution of said cavity to said frequency variation in said TM01δ is said predetermined proportion of that in said TE01δ mode.

4. A dielectric resonance device according to claim 1, wherein the capacitance-generation electrode is formed by an electrically conductive member which projects toward the interior of the cavity.

5. A dielectric resonance device according to claim 4, wherein the capacitance-generation electrode is formed by a screw which projects from the inner wall surface of the cavity.

6. A dielectric resonance device according to claim 4, wherein the capacitance-generation electrode is formed by an electrically conductive plate attached to the inner wall surface of the cavity.

7. A dielectric resonance device according to any one of claims 1 to 4, wherein a capacitance between the dielectric core and the cavity and said capacitance between the electrode and the support-base attachment surface vary with temperature in opposite directions.

8. A dielectric filter comprising a dielectric resonance device according to claim 7, and a coupling member which couples with a resonance mode of the dielectric resonance device and through which signals are input and output.

9. A communication apparatus comprising a dielectric filter according to claim 8, a high-frequency circuit comprising one of a transmission circuit and a reception circuit being connected to said coupling member.

10. A composite dielectric filter device comprising a plurality of dielectric filters according to claim 8.

11. A dielectric duplexer comprising first and second dielectric filters according to claim 8, wherein an input port of the first filter is used as a transmission signal input port, an output port of the second filter is used as a reception signal output port, and a common input/output port of the first and second filters is used as an antenna port.

12. A communication apparatus comprising a dielectric duplexer according to claim 11; a transmission circuit being connected to said transmission signal input port; and a reception circuit being connected to said reception signal output port.

13. A dielectric resonance device comprising:

an electrically conductive cavity;

a dielectric core fixedly disposed within the cavity via a support base, the dielectric core being capable of resonating in a TM mode; and a capacitance-generation electrode having the same electrical potential as that of the cavity and provided at a predetermined position between an inner wall surface of the cavity and a predetermined surface of the dielectric core, such that a predetermined capacitance is produced between the electrode and the dielectric core, further wherein the dielectric core resonates in TM01δ and TE01δ modes at substantially the same resonance frequency; and the shapes, sizes, and materials of the dielectric core, cavity, and capacitance-generation electrode are determined such that, when temperature varies, the resonance frequency of the TM01δ mode varies in the same direction as that of the resonance frequency of the TE01δ mode.

14. A method of manufacturing a dielectric resonance device comprising the steps of:

providing a dielectric core fixedly disposed within an electrically conductive cavity via a support base, the dielectric core being capable of resonating in a TM mode; and disposing a capacitance-generation electrode having the same electrical potential as that of the cavity, at a predetermined position between an inner wall surface of the cavity and a predetermined surface of the dielectric core, such that a predetermined capacitance is produced between the electrode and the dielectric core, further wherein the dielectric core resonates in TM01δ and TE01δ modes at substantially the same resonance frequency; and the shapes, sizes, and materials of the dielectric core, cavity, and capacitance-generation electrode are determined such that, when temperature varies, the resonance frequency of the TM01δ mode varies in the same direction as that of the resonance frequency of the TE01δ mode.

* * * * *